US006133539A

United States Patent [19]

Yao

[11] Patent Number: 6,133,539

[45] Date of Patent: Oct. 17, 2000

[54] KEY SWITCH

[75] Inventor: Huan-Ming Yao, Tao-Yuan, Taiwan

[73] Assignee: Hon Hai Precision Ind. Co., Ltd., Taipei Hsien, Taiwan

[21] Appl. No.: 09/330,524

[22] Filed: Jun. 11, 1999

[30] Foreign Application Priority Data

Jan. 12, 1999 [TW] Taiwan ..... 88200438

[51] Int. Cl.[7] ..... H01H 13/14

[52] U.S. Cl. ..... 200/517; 200/345

[58] Field of Search ..... 200/5 A, 512, 200/517, 341, 344, 345; 400/472, 490, 491, 491.2, 495, 495.1

[56] References Cited

U.S. PATENT DOCUMENTS 4,515,999 5/1985 Harper ..... 200/5 A
5,120,923 6/1992 Kato et al. ..... 200/520
5,172,990 12/1992 Weng ..... 400/490
5,380,969 1/1995 Yang ..... 100/517
5,418,530 5/1995 Moore et al. ..... 341/22

*Primary Examiner*—Michael Friedhofer
*Attorney, Agent, or Firm*—Wei Te Chung

[57] ABSTRACT

A key switch comprises a key cap, a support device, a support board, a membrane circuit, and a base. A number of slots formed on sides of the support device engage with hooks of the key cap whereby the key cap is slidably engaged with the support device. A number of protrusions outwardly extends from edges of a bottom surface of the support device to engage corresponding U-shaped positioning portions. Thus, the height of the key switch is limited and the assembly thereof is simplified.

11 Claims, 6 Drawing Sheets

KEY SWITCH

BACKGROUND OF THE INVENTION

The present invention relates to a key switch which can be conveniently assembled and which has a low profil while can have a sufficient vertical travel when it is depressed to input a signal to a computer.

The most common way of inputting information into a computer is through a keyboard including a number of key switches to be depressed. Each key switch must have a sufficient vertical displacement to activate the switch whereby the key switch will not be too sensitive to control. As computers become smaller and lighter, key switches of a keyboard should be designed to have a limited height.

Referring to FIG. 1, a key cap 92 of a key switch 90 is mounted on a support board 94. A plunger 96 of the key cap 92 compresses a rubber spring 98 causing vertical displacement thereof. The plunger 96 must have a sufficient vertical displacement to be inserted into the support board 94, otherwise the key cap 92 may become locked. However, since the plunger 96 is integral, it has a quite large height to implement the sufficient vertical displacement.

Referring to FIG. 2, a key switch 80 comprises a linkage group 82 comprising links connected together by engaging means. The ends of the linkage group 82 are mounted to a key cap 84 and a support board 86, respectively. Since the linkage group must be accurately assembled, assembly becomes time consuming. Hence, a key switch which can be easily assembled and which promotes conservation of space is requisite.

The related prior art is disclosed in U.S. Pat. Nos. 5,457,297; 5,463,195; 5,512,719.

BRIEF SUMMARY OF THE INVENTION

A main object of the present invention is to provide a key switch having a limited height.

Another object of the present invention is to provide a key switch which can be conveniently assembled.

According to the present invention, a key switch comprises a key cap, a support device, a support board, a membrane circuit, and a base. A plurality of slots formed on sides of the support device engage with hooks of the key cap whereby the key cap is slidably engaged with the support device. A plurality of protrusions outwardly extends from edges of a bottom surface of the support device to engage corresponding U-shaped positioning portions. Thus, the height of the key switch is limited. In assembly, the key cap, the support device, the support board, and the rubber board are pressed together thereby simplifying the assembly process.

Other objects, advantages and novel features of the invention will become more apparent from the following detailed description when taken in conjunction with the accompanying drawings.

DETAILED DESCRIPTION OF THE INVENTION

Figure 1:
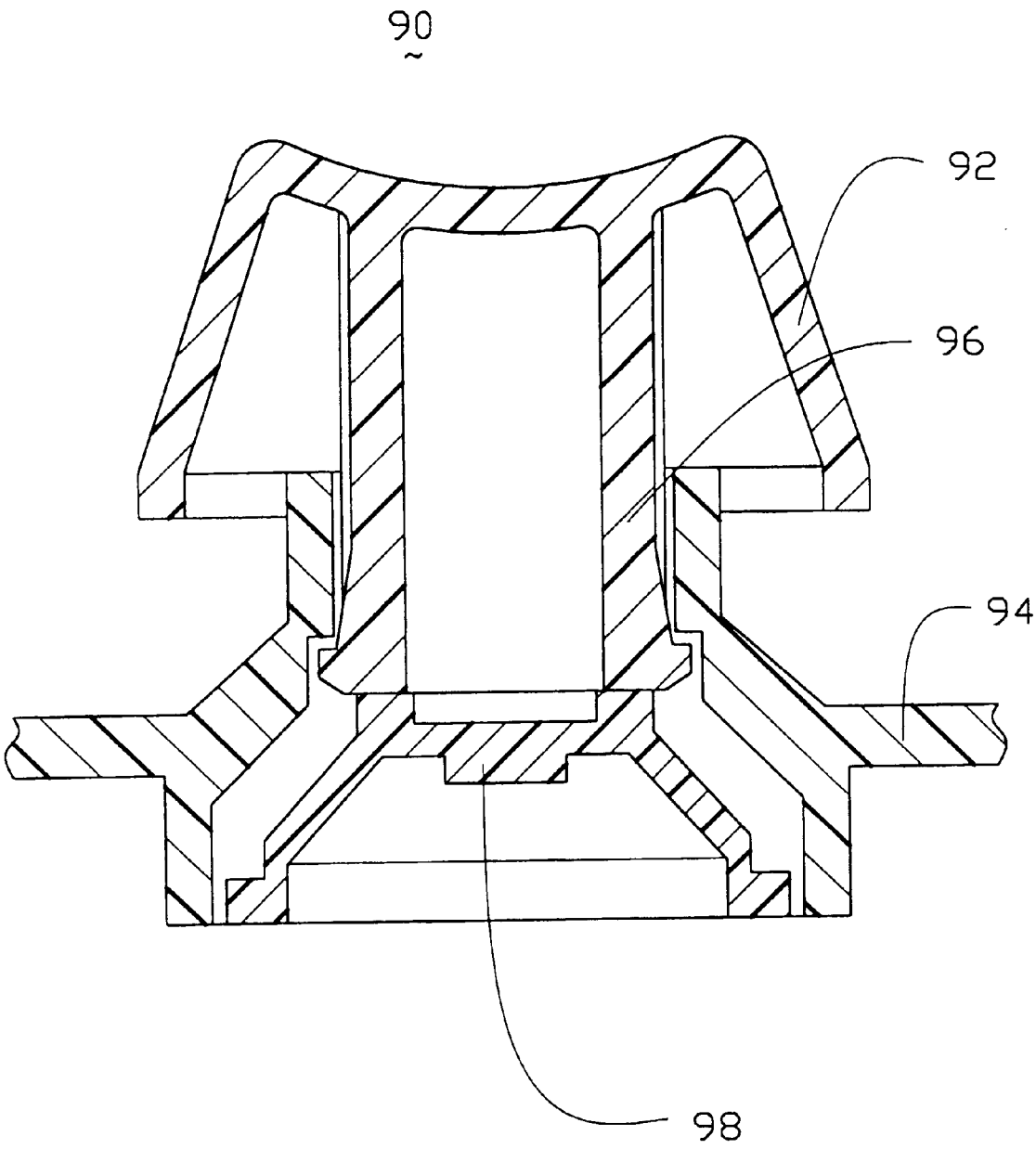
FIG. 1 (PRIOR ART)
FIG. 1 is a cross sectional view of a conventional key switch.
Figure 2:
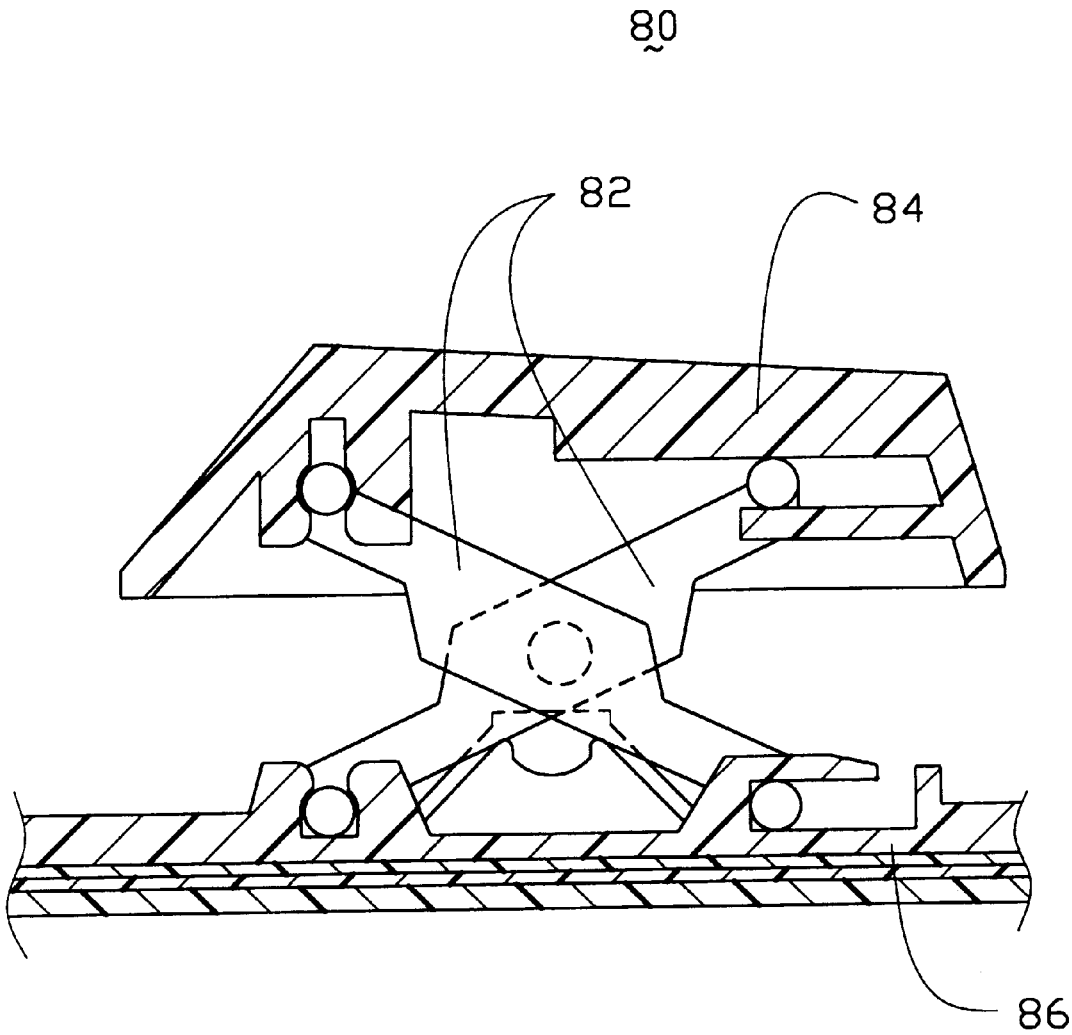
FIG. 2 (PRIOR ART)
FIG. 2 is a cross-sectional view of another conventional key switch.
Figure 3:
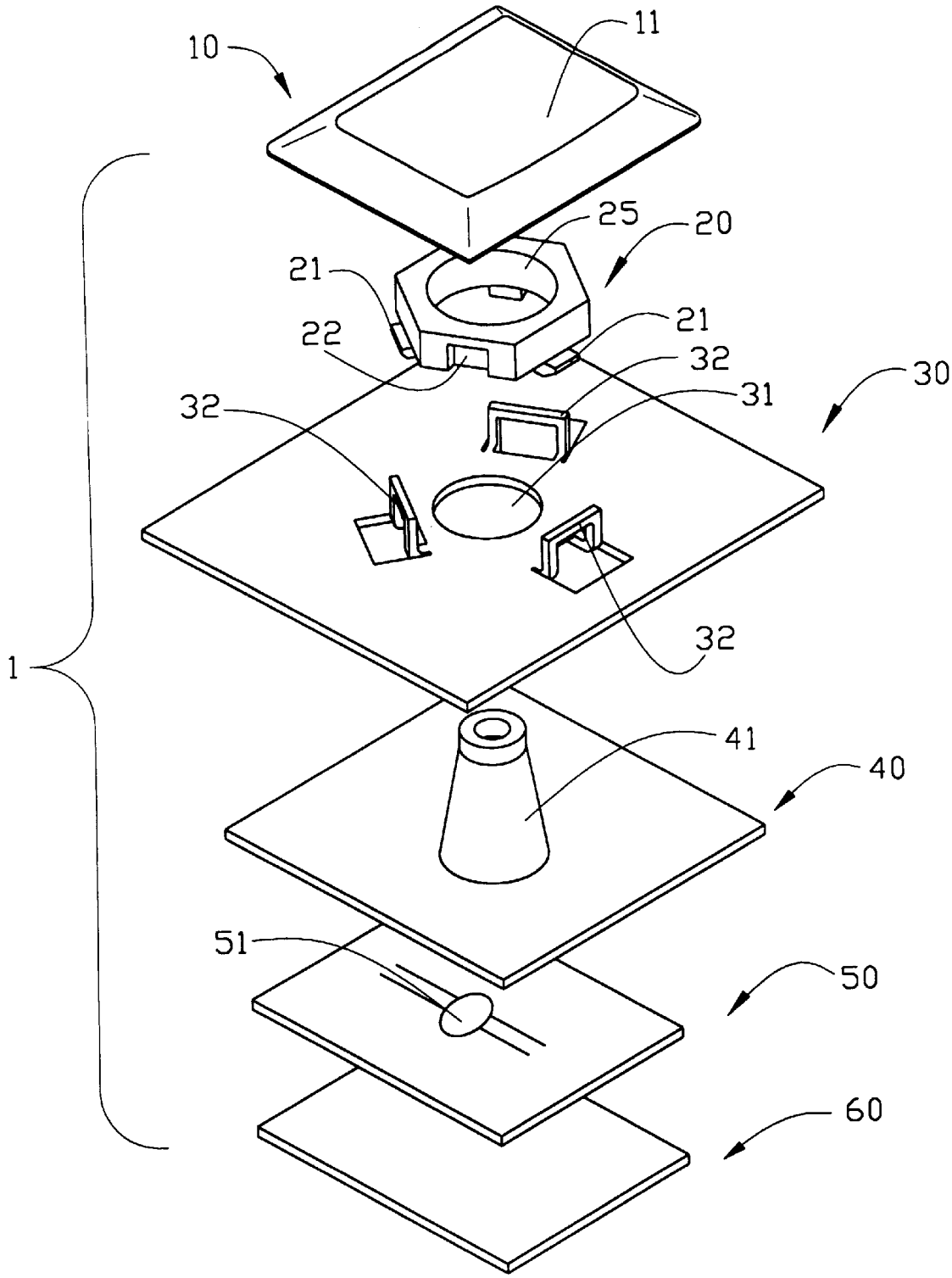
FIG. 3 is an exploded view of a key switch of the present invention.
Figure 4:
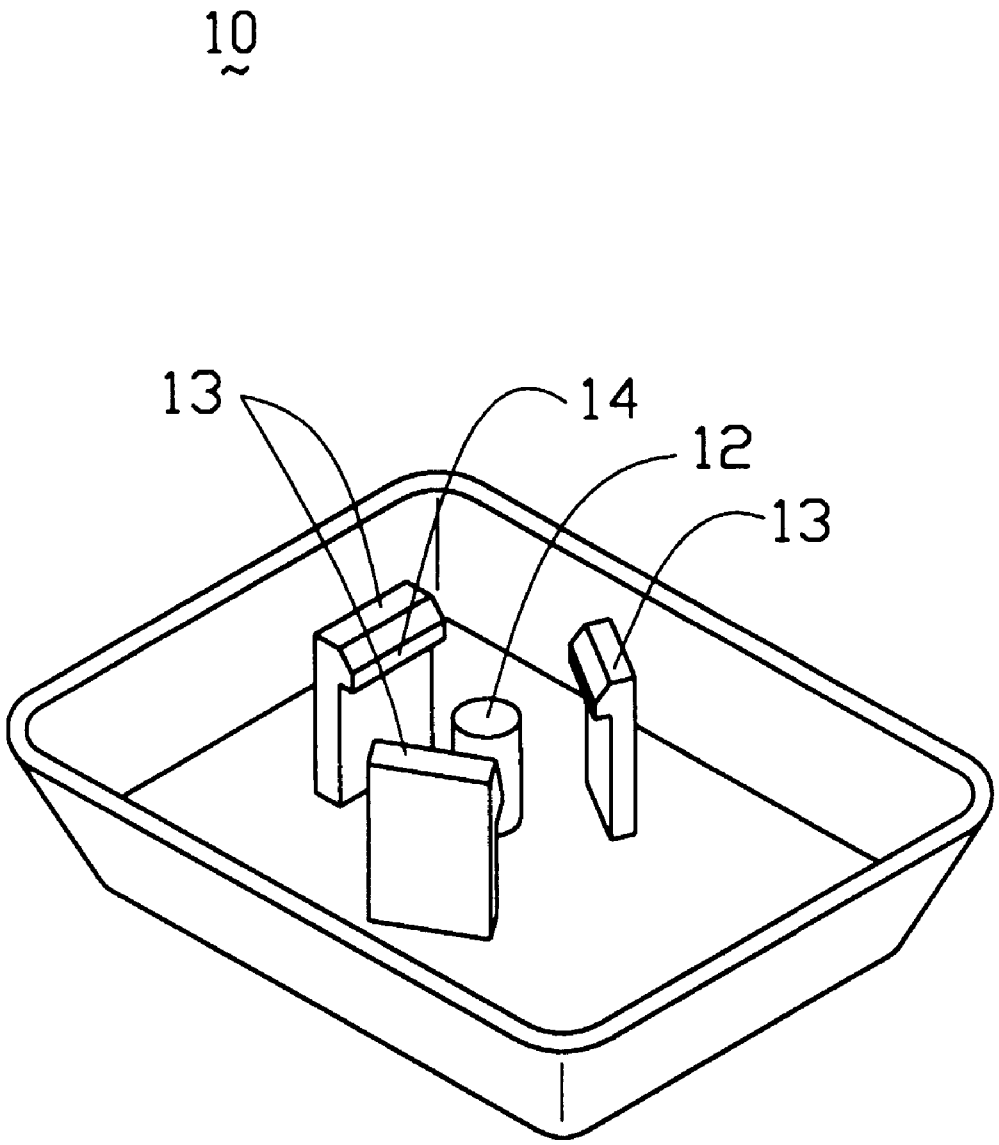
FIG. 4 is a bottom perspective view of a key cap of the present invention.
Figure 5:
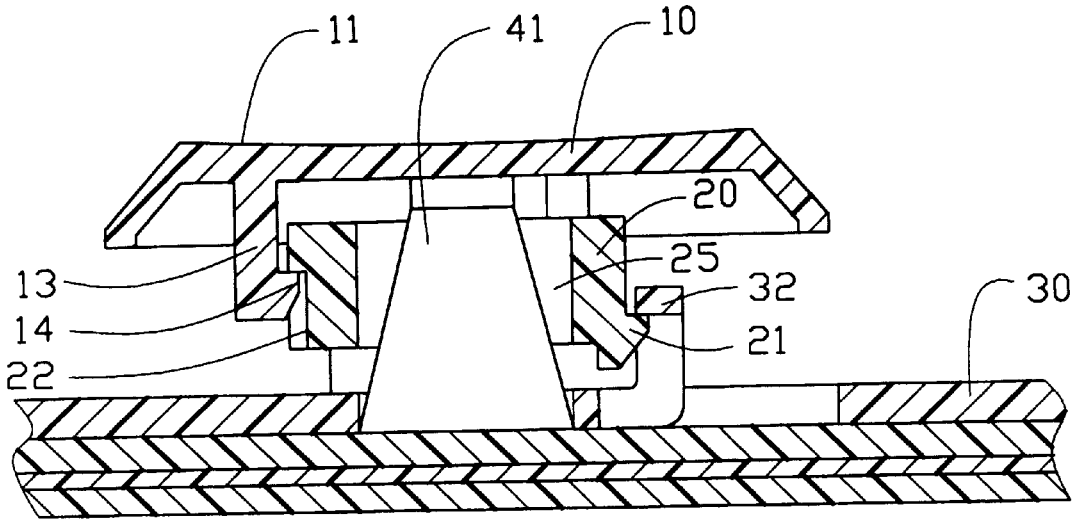
FIG. 5 is a cross-sectional view of the assembled key switch at an unpressed state.

Referring to FIGS. 3–5 , a key switch 1 in accordance with the present invention generally comprises a key cap 10, a support device 20, a support board 30, a rubber board 40, a membrane circuit 50 and a base 60.

The key cap 10 comprises a top surface 11 for receiving an external depression force and a periphery sloping downwardly from four sides thereof, a plunger 12 extending downwardly from a center of the key cap 10, and a plurality of hooks 13 extending downwardly from the key cap 10 equidistant from the plunger 12. Each hook 13 forms a barb 14 at a free end thereof extending toward the plunger 12.

The support device 20 is shaped as a hexagonal plate comprising having therein a central through hole 25 and a plurality of protrusions 21 extending outwardly from a bottom face thereof. Each protrusion 21 has an inclined face 211. A plurality of depressions 22 are formed in sides of the supporting device 20 and exposed to the bottom face. Each depression 22 receives the corresponding barb 14 of the corresponding hook 13 of the key cap 10 whereby the key cap 10 is slidably engaged with the support device 20. Each protrusion 21 and each depression 22 are formed on a center portion of alternate sides of the support device 20.

The support board 30 comprises a hole 31 and a plurality of U-shaped positioning portions 32 mating the corresponding protrusions 21 of the support device 20 whereby the support device 20 is slidably fixed to the support board 30.

The rubber board 40 includes a rubber spring 41 forming a space therein for receiving the plunger 12. A pin (not shown) is formed in the space of the rubber spring 41 at a base thereof. When the key cap 10 is depressed by an external force, the rubber spring 41 will deform and the pin will be displaced downward. The rubber board 40 and the rubber spring 41 can be integrally or separately formed.

The membrane circuit 50 has an electrical contact 51 formed thereon. When the plunger 12 is depressed, the pin of the rubber spring 41 contacts the electrical contact 51 causing the membrane circuit 50 to produce an electrical signal. When the force is removed from the key cap 10, the rubber spring 41 resumes to its original shape thereby disengaging from the membrane circuit 51. The base 60 supports the membrane circuit 50, the rubber board 40 and the support board 30.

During assembly, the rubber spring 41 extends through the opening 31 of the support board 3. The rubber board 40 is supported on the membrane circuit 50 above the base 60. The support portion 20 is pressed to engage with the support board 3 whereby each protrusion 21 mates with the corresponding positioning portion 32. The protrusion 21 slides into the positioning portion 32 along its inclined face. The plunger 12 is received in the space of the rubber spring 41 and the barbs 14 of the hooks 13 engage the corresponding depressions 22 of the support device 20. Thus, the support device 20 has a simple structure and can be easily assembled.

Figure 6:
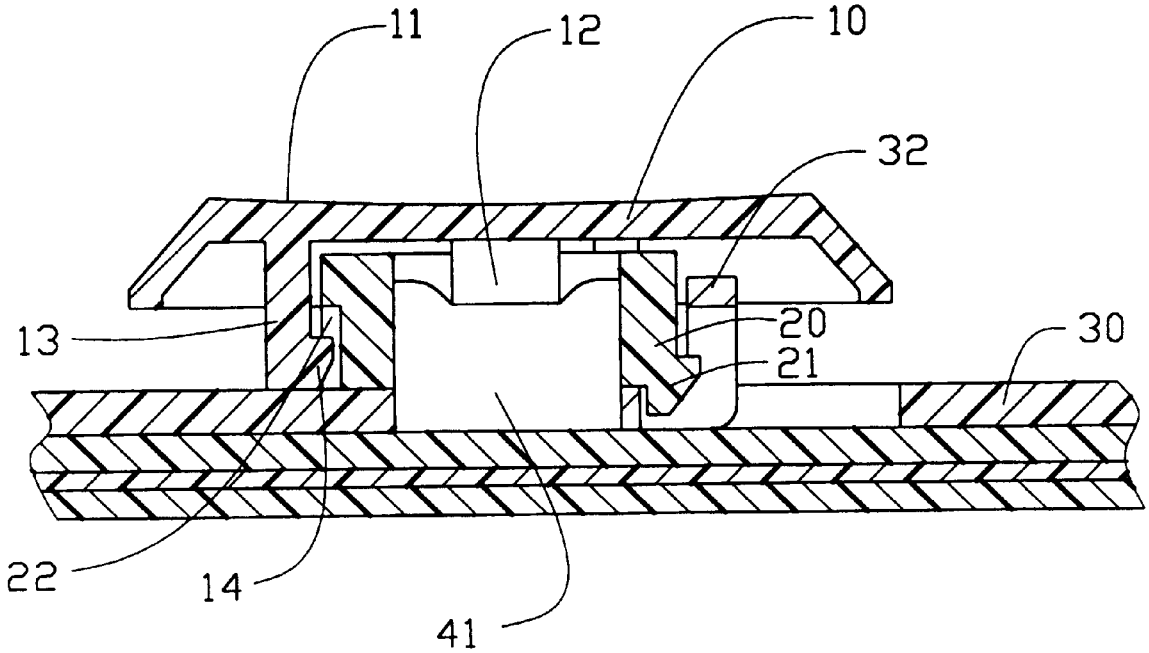
FIG. 6 is a cross-sectional view of the assembled key switch at a depressed state.

Referring to FIGS. 5 and 6, by pressing the top surface 11 of the key cap 10, the support device 20 with the key cap 10 is displaced downwardly and each protrusion 21 moves within an opening of the positioning portion 32 due to the gravity thereof until the support device 20 abuts against the support board 30. This is the first stage. By pressing the key cap 10 further, the barb 14 of each hook 13 slides downwardly along the depressions 22 until the hooks 13 abut against the support board 30. This is the second stage, as shown in FIG. 6. It is noted that during the first and second stages, the plunger 12 causes the rubber spring 41 to deform. Oppositely, when the force exerted on the key cap 10 is released, the rubber spring 41 immediately resumes to its original shape, and the support device 20 is displaced upwardly until the protrusions 21 re-engage the positioning portions 32, as shown in FIG. 5.

It can be understood that the invention is to provide a multiple telescopic joint structure to replace the prior art two-piece mechanism wherein the joints between the cap and the support device 20 and the joints between the support board 30 and the support device 20 are alternately arranged with each other circumferentially for no interference therebetween, thus resulting in a simple, low profile structure thereof.

The preferred embodiment is described as a structure enabling two stages of movement. A structure enabling a plurality of stages of movement to promote a sound engagement and displacement of a key switch can also be used.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A key switch comprising:

a key cap having a plunger extending downwardly from a center thereof and at least two hooks extending downwardly therefrom about the plunger;

a support device including at least two protrusions outwardly extending from edges of a bottom surface thereof, and at least two depressions formed on outer sides thereof for slidably receiving the at least two hooks of the key cap on outer sides of the support device;

a support board having at least two positioning portions for engaging the at least two protrusions of the support device;

a membrane circuit having an electrical contact;

a rubber board positioned between the support board and the membrane circuit, the rubber board having a rubber spring for receiving the plunger of the key cap and for contacting the electrical contact of the membrane circuit in response to a downward movement of the key cap; and a base supporting the membrane circuit, the rubber board and the support board;

the at least two protrusions of the support device being downwardly slidable in the at least two positioning portions of the support board when an external force is exerted on the key cap, and the support device being upwardly displaceable to engage the at least two protrusions with the at least two positioning portions when the force is released.

2. The key switch as claimed in claim 1, wherein each of the at least two depressions is exposed to a bottom surface of the support device.

3. The key switch as claimed in claim 2, wherein the support device is hexagonal.

4. The key switch as claimed in claim 1, wherein the at least two hooks of the key cap are equidistant from the plunger.

5. The key switch as claimed in claim 4, wherein a barb extends from a free end of each of said at least two hooks toward the center of the key cap.

6. The key switch as claimed in claim 1, wherein each of the at least two protrusions and each of the at least two depressions are formed on individual centers of alternate outer sides of the support device.

7. Retraction mechanism of a key switch, comprising:

a key cap;

a support board positioned under the key cap;

a membrane circuit mounted under the support board;

a vertically deformable rubber spring engageably positioned between the cap and the membrane circuit; and a support device positioned between the cap and the support board, said support device including means for slidably engaging with the cap in selected sides thereof and the support board in alternate sides thereof relative to the selected sides, so that the cap, the support device and the support board function as a telescopic tube when the cap is downwardly pressed by a force for vertically deforming the rubber spring to activate the membrane circuit under the support device and the support board.

8. The mechanism as claimed in claim 7, wherein said engaging means is arranged circumferentially on outer sides of the support device.

9. The key switch as claimed in claim 4, wherein a barb extends from a free end of each of the at least two hooks toward the center of the key cap.

10. A key switch comprising:

a key cap having a plunger extending downwardly from a center thereof and at least two hooks extending downwardly therefrom about the plunger;

a support device including at least two protrusions outwardly extending from edges of a bottom surface thereof, at least two depressions formed on sides thereof for slidably receiving the at least two hooks of the key cap, respectively;

a support board having at least two positioning portions for respectively engaging said at least two protrusions of the support device;

a membrane circuit mounted under the support board and having an electrical contact;

a rubber board having a rubber spring for receiving the plunger and for contacting the electrical contact in response to a downward movement of the key cap; and a base supporting the membrane circuit, the rubber spring and the support board;

each of said at least two protrusions being downwardly slidable in the corresponding one of said at least two positioning portions when an external force is exerted on the key cap, and the support device being upwardly displaceable to engage each of said at least two protrusions with the corresponding one of said at least two positioning portions when the force is released; wherein a barb extends from a free end of each of said at least two hooks toward the center of the key cap.

11. Retraction mechanism of a key switch, comprising:

a key cap;

a support board positioned under the key cap and defining a hole;

a rubber board positioned under the support board;

a membrane circuit positioned under the rubber board a vertically deformable rubber spring extending through the hole with two opposite ends thereof respectively abutting against the key cap and the rubber board; and a support device positioned between the cap and the support board, said support device e defining a central through hole which rubber spring extends through, and including means for respectively slidable engagement with the cap and the support board, so that the cap, the support device and the support board can function as a telescopic tube when the cap is downward pressed by a force for vertically deforming the rubber spring to activate membrane circuit thereunder; wherein when no downward force is imposed upon the key cap, said rubber spring applies sufficient upward force to the key cap, thus urging said telescopic tub to be in an extended manner without activating membrane circuit thereunder; when a downward force is imposed upon the key cap, said rubber spring is squeezed and said telescopic tube is urged to be in a retracted manner with activating membrane circuit thereunder.

* * * * *